US011650013B2

(12) United States Patent
Rosenfellner

(10) Patent No.: US 11,650,013 B2
(45) Date of Patent: May 16, 2023

(54) CONVEYING A MATERIAL TO BE CONVEYED

(71) Applicant: Primetals Technologies Austria GmbH, Linz (AT)

(72) Inventor: Gerald Rosenfellner, Ertl (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 709 days.

(21) Appl. No.: 16/611,033

(22) PCT Filed: May 3, 2018

(86) PCT No.: PCT/EP2018/061298
§ 371 (c)(1),
(2) Date: Nov. 5, 2019

(87) PCT Pub. No.: WO2018/206383
PCT Pub. Date: Nov. 15, 2018

(65) Prior Publication Data

US 2020/0103170 A1 Apr. 2, 2020

(30) Foreign Application Priority Data

May 12, 2017 (EP) ..... 17170804

(51) Int. Cl.
*F27B 9/04* (2006.01)
*F27D 7/04* (2006.01)
(Continued)

(52) U.S. Cl.
CPC ..... *F27B 9/047* (2013.01); *F27B 19/02* (2013.01); *F27D 3/00* (2013.01); *F27D 7/04* (2013.01); *F27D 2007/063* (2013.01)

(58) Field of Classification Search
CPC ..... F27B 19/02; F27B 9/045; F27B 9/047; F27D 2007/063; F27D 3/00; F27D 7/04
(Continued)

(56) References Cited

U.S. PATENT DOCUMENTS 3,036,440 A * 5/1962 Feinman ..... C21B 13/0086 62/375
7,150,627 B2 * 12/2006 Gaur ..... F27B 9/047 432/128
(Continued)

FOREIGN PATENT DOCUMENTS

CN 201842461 * 5/2011 ..... F27D 3/00
DE 100 23 702 A1 11/2001
(Continued)

OTHER PUBLICATIONS

Russian Federation Office Action, dated Sep. 23, 2021, issued in corresponding Russian Patent Application No. 2019136871/05(072908). Total 9 pages.
(Continued)

*Primary Examiner* — Scott R Kastler
*Assistant Examiner* — Michael Aboagye
(74) *Attorney, Agent, or Firm* — Ostrolenk Faber LLP

(57) ABSTRACT

A conveying system (1) for conveying a material along a conveying path. The system (1) includes a system housing (3) having a conveying chamber (5), in which the conveying path is arranged, and having at least one secondary chamber (6 to 8), which is connected to the conveying chamber (5) by at least one passage opening and has a fluid atmosphere that is physically and/or chemically different from the fluid atmosphere in the conveying chamber (5). The at least one passage opening (9, 10) and the fluid atmospheres in the
(Continued)

conveying chamber (5) and the at least one secondary chamber (6 to 8) set a defined fluid flow in the system housing (3).

13 Claims, 8 Drawing Sheets

(51) Int. Cl.
*F27D 3/00* (2006.01)
*F27B 19/02* (2006.01)
*F27D 7/06* (2006.01)

(58) Field of Classification Search
USPC ..... 432/23; 198/860.3, 860.5, 952, 735.2
See application file for complete search history.

(56) References Cited

U.S. PATENT DOCUMENTS

| | | | | |
|---|---|---|---|---|
| 7,228,960 | B2 * | 6/2007 | Muller | C21B 13/0086 198/860.3 |
| 8,202,474 | B2 | 6/2012 | Fischer | |
| 8,490,416 | B2 * | 7/2013 | Nemer | F27D 9/00 62/63 |
| 10,215,510 | B2 * | 2/2019 | Seidel | B65G 13/00 |
| 10,947,050 | B2 * | 3/2021 | Rosenfellner | B65G 69/182 |
| 2001/0051323 | A1 | 12/2001 | Nishimura | 432/11 |
| 2004/0057816 | A1 | 3/2004 | Nunemacher | |
| 2004/0063058 | A1 | 4/2004 | Orbeck et al. | 432/128 |
| 2004/0197168 | A1 | 10/2004 | Meurs | |
| 2006/0246391 | A1 | 11/2006 | Gaur | |
| 2011/0318698 | A1 * | 12/2011 | Gaur | F27D 9/00 432/85 |
| 2014/0131930 | A1 | 5/2014 | Katsumata | |
| 2016/0069615 | A1 | 3/2016 | Choo et al. | |
| 2020/0103170 | A1 | 4/2020 | Rosenfellner | |

FOREIGN PATENT DOCUMENTS

| | | | | |
|---|---|---|---|---|
| EP | 1 898 170 | A2 | 3/2008 | |
| KR | 20040042020 | * | 5/2004 | F27D 3/00 |
| RU | 2011134 | C1 | 4/1994 | |
| RU | 2013731 | C1 | 5/1994 | |
| RU | 2146033 | C1 | 2/2000 | |
| RU | 2335720 | C2 | 10/2008 | |
| RU | 2429435 | C1 | 9/2011 | |
| RU | 2443960 | C1 | 2/2012 | |
| SU | 521443 | A1 | 7/1976 | |
| TW | 200728171 | A | 8/2007 | |
| WO | WO 2018/206383 | A1 | 11/2018 | |

OTHER PUBLICATIONS

Taiwan Office Action, dated Sep. 14, 2021, issued in corresponding Taiwanese Patent Application No. 107115452. English translation. Total 9 pages.

International Search Report dated Jun. 29, 2018 in corresponding PCT International Application No. PCT/EP2018/061298.

Written Opinion dated Jun. 29, 2018 in corresponding PCT International Application No. PCT/EP2018/061298.

Extended European Search Report dated Nov. 29, 2017 in corresponding European Patent Application No. 17170804.3.

* cited by examiner

CONVEYING A MATERIAL TO BE CONVEYED

CROSS-REFERENCE TO RELATED APPLICATIONS

The present application is a 35 U.S.C. §§ 371 national phase conversion of PCT/EP2018/061298, filed May 3, 2018, the contents of which are incorporated herein by reference which claims priority of European Patent Application No. 17170804.3, filed May 12, 2017, the contents of which are incorporated by reference herein. The PCT International Application was published in the German language.

TECHNICAL FIELD

The invention relates to a conveying installation and a method for conveying a material for conveying. In particular, the invention relates to the conveyance of reactive and/or hot and/or abrasive material for conveying.

A reactive material for being conveyed means a material for being conveyed which reacts chemically and/or physically with environmental substances surrounding the conveying installation, for example with air, in particular with the oxygen of the air. In the conveyance of such a material, various demands are placed on its conveying installation. In the conveyance of hot material, the conveying mechanism of the conveying installation is also subjected to high temperatures, such that it must be cooled or must be fabricated from expensive heat-resistant materials. In the conveyance of such a reactive material and for example as a result of chemical reactions of the material being conveyed, it is possible that due to, for example, oxygen from the environment, harmful and/or environmentally damaging gas may escape from the material being conveyed, and/or the material being conveyed can heat up intensely as a result of the reactions, which can lead to material damage to the material being conveyed and/or to safety problems. In order to prevent contact of reactive material with, for example, oxygen, use is often made of an inert gas, for example nitrogen, in order to keep oxygen out of the environment of the material being conveyed. Furthermore, in the conveyance of such a material, dust often forms, which can likewise have a harmful and/or environmentally damaging effect and/or can be detrimental to sub-components of the conveying installation, and so the dust must be extracted from the conveying installation and disposed of.

US 2004/0063058 A1 discloses a multi-zone convection furnace in which gas from a cooling chamber of the furnace is conducted into one or more heating zones of the furnace in order to provide a specific thermal profile. The gas that is introduced from the cooling chamber into the one or more heating zones is of the same type of gas that is present in the heat zones, and is typically nitrogen.

SUMMARY OF THE INVENTION

The object of the invention is to provide a conveying installation and a method for conveying a material for being conveyed which are improved in particular with regard to the conveyance of reactive, hot and/or abrasive material being conveyed.

A conveying installation according to the invention for conveying a material for being conveyed along a conveying path comprises an installation housing with a conveying chamber, in which at least the conveying path is arranged, and with at least one secondary chamber, which is connected by means of at least one passage opening to the conveying chamber and which has a fluid atmosphere which differs physically and/or chemically from a fluid atmosphere in the conveying chamber. The at least one passage opening and the fluid atmospheres in the conveying chamber and in the at least one secondary chamber are configured for setting a defined fluid flow in the installation housing.

A chamber of an installation housing here means a substantially closed cavity of the installation housing. A fluid atmosphere in a chamber means its physical and chemical characteristics, for example the chemical composition, the pressure or the temperature, of a fluid that is situated in the chamber. A fluid means a gas or a liquid.

A conveying installation according to the invention thus permits a defined fluid flow in an installation housing of the conveying installation. This is achieved by division of the installation housing into a conveying chamber and at least one secondary chamber, which chambers have mutually different fluid atmospheres and which are connected by at least one passage opening. Arrangement of the conveying path in a conveying chamber permits substantial encapsulation of the conveying path with respect to the environment, such that the material being conveyed is substantially partitioned off with respect to environmental substances, particularly oxygen, from the environment. The setting of a defined fluid flow by means of mutually different fluid atmospheres in the conveying chamber and in the at least one secondary chamber additionally makes it possible for environmental substances and in particular oxygen to be kept out of the region of the material for being conveyed, and permits the defined discharge of harmful and/or environmentally damaging gases and dust out of the conveying chamber along with the fluid flow.

One embodiment of the invention provides for the installation housing to have at least one fluid inlet and at least one fluid outlet and to be otherwise of fluid-tight design aside from the at least one fluid inlet and the at least one fluid outlet. Fluid-tightness means fluid-tightness that satisfies a technical specification. The substantially fluid-tight design of the installation housing restricts escape of fluid from the installation housing to the fluid outlets, such that only a relatively small amount of fluid escapes from the installation housing. Furthermore, the emergence of fluid through the defined fluid outlets makes it possible for fluid that emerges from the installation housing to be targeted and at least partially collected and fed back to the installation housing. In this way, the consumption and the costs of the fluid used are advantageously reduced. The substantially fluid-tight design of the installation housing furthermore advantageously reduces ingress of environmental substances surrounding the conveying installation into the installation housing.

A further embodiment of the invention provides for an end of the conveying chamber, which is arranged in the region of the start of a conveying path, to be closed or closable. In this way, the direction of the fluid flow can be easily aligned with the transport direction of the material being conveyed.

The invention furthermore provides at least one component of a conveying mechanism for the conveying to be arranged in at least one secondary chamber. This advantageously makes it possible for sensitive components of the conveying mechanism to not be arranged in the conveying chamber but rather in a secondary chamber, whereby the sensitive components may be removed from the influence of high temperatures, dust and/or corrosive gases in the conveying chamber. Thus, components of the conveying mechanism can be protected against often adverse fluid atmosphere in the conveying chamber by the components being relocated into a secondary chamber. Furthermore, arranging those components of the conveying mechanism in a secondary chamber can be utilized to relatively easily cool the components in the secondary chamber, for example by fluid that is conducted into the secondary chamber and/or by a separate cooling device.

A further embodiment of the invention provides for the conveying mechanism to have a traction mechanism drive with at least one traction mechanism which is arranged in a secondary chamber and by means of which carrier elements for conveying the material being conveyed are movable. The material for conveying is for example transported directly by the carrier elements or in containers arranged on the carrier elements. Here, for example, the carrier elements separate the conveying chamber from a secondary chamber in which at least one traction mechanism is arranged. Alternatively, the carrier elements are arranged in the conveying chamber and project through a passage opening into at least one secondary chamber, in particular into a secondary chamber which is arranged laterally at the conveying chamber and in which a traction mechanism is arranged. The traction mechanism drives and the carrier elements that are moved by the traction mechanism are particularly highly suitable for being so moved, inter alia, owing to their robustness and their low maintenance requirements, for transporting reactive, hot and/or abrasive material being conveyed. Arrangement of a traction mechanism in a secondary chamber protects the traction mechanism against high temperatures, dust and/or corrosive fluids in the conveying chamber. When a conveying chamber is separated from a secondary chamber in which at least one traction mechanism is arranged, the carrier elements can be used not only for transporting the material being conveyed but at the same time for partitioning off the secondary chamber from the conveying chamber. For a traction mechanism being in a secondary chamber arranged laterally of the conveying chamber, the traction mechanism is spatially further separated from the material being conveyed, which is advantageous in particular in the transport of hot material for conveying, because the traction mechanism is then heated less intensely by the material being conveyed, and that mechanism therefore also requires less intense cooling.

A further embodiment of the invention provides an opening width of at least one passage opening to vary along the course of the passage opening. Regions of a secondary chamber with relatively narrow passage openings are particularly advantageously suitable for cooling of components, which are arranged there in the narrow opening of the conveying mechanism by means of fluid conducted into the secondary chamber, because particularly high fluid flows of the fluid arise in the narrowed regions. Furthermore, regions of a secondary chamber with relatively narrow passage openings are particularly advantageously suitable for the introduction of fluid into the secondary chamber, because less fluid flows from the secondary chambers into the conveying chamber in these regions than in regions with further passage openings. As a result, the introduced fluid can be distributed over greater regions of the secondary chamber. By contrast, regions with relatively wide passage openings are advantageously suitable for targeted conducting of relatively large amounts of fluid into the conveying chamber and thus for more intensely influencing the fluid flow in the conveying chamber. Therefore, through targeted variation of the opening width of a passage opening, it is possible for suitable regions of the secondary chamber to be defined for the cooling of components of the conveying mechanism or of other components of the conveying installation, for example the above-stated carrier elements, for positioning of fluid inlets and for influencing of fluid flow in the installation housing.

A further embodiment of the invention provides a cooling device for cooling at least one secondary chamber. This makes it possible in particular for components of the conveying mechanism that are arranged in the secondary chamber to be cooled when cooling by means of the fluid is not provided or is not sufficient.

A further embodiment of the invention provides a fluid circuit system which comprises at least one secondary chamber and which is configured for conducting a fluid through at least one passage opening from the secondary chamber into the conveying chamber. Such a fluid circuit system makes it advantageously possible for the consumption of fluid to be further lowered, because fluid discharged from a secondary chamber is fed via the fluid circuit system back to a secondary chamber, such that the fluid remains in the fluid circuit system.

The fluid circuit system may include at least one heat exchanger for cooling a fluid fed to a secondary chamber. In this way, the fluid that is cooled by means of the heat exchanger and subsequently conducted into a secondary chamber can advantageously also be used for cooling components, arranged in the secondary chamber, of the conveying mechanism.

Furthermore, the conveying installation may have a fluid recycling unit for receiving fluid from the conveying chamber and for feeding fluid back into the conveying chamber, wherein the fluid may be fed back directly and/or via the fluid circuit system. The fluid recycling unit may have a fluid cleaning unit for cleaning the fluid received from the conveying chamber. In this way, fluid that emerges or is extracted from the conveying chamber can be at least partially collected and recycled by being fed back into the conveying chamber. Here, it is not necessary for fluid to be fed to the fluid recycling unit directly from the conveying chamber. It rather is also possible for fluid to be discharged from the conveying chamber into an apparatus connected downstream of the conveying installation, for example into a bunker into which the material for conveying is conveyed, and for the fluid to be fed from the apparatus to the fluid recycling unit. The consumption of fluid can advantageously be lowered in this way. Since fluid emerging or extracted from the conveying chamber often contains dust and/or gas that has escaped from the material being conveyed, a fluid cleaning unit can be advantageous for cleaning the fluid that is received from the conveying chamber.

A further embodiment of the invention provides a closed-loop control system for closed-loop control of a fluid flow from at least one secondary chamber into the conveying chamber in a manner dependent on a pressure difference between a pressure in the secondary chamber and a pressure in the conveying chamber. This enables the fluid flow to be advantageously set particularly accurately as required.

In a method according to the invention for operating a conveying installation according to the invention, a higher fluid pressure is set in each secondary chamber than in the conveying chamber. This causes fluid flows from each secondary chamber into the conveying chamber, and not in the opposite direction from the conveying chamber into a secondary chamber. The higher fluid pressure in each secondary chamber in relation to the pressure in the conveying chamber, and the resulting fluid flow from each secondary chamber into the conveying chamber, advantageously also prevents the ingress of fluid that has escaped from the material being conveyed, and/or of dust that has formed during the transport of the material being conveyed, into a secondary chamber.

In one embodiment of the method a fluid recycling unit recycles fluid from the conveying chamber to be fed back into the conveying chamber directly and/or via at least one secondary chamber. The consumption of fluid can be advantageously lowered. In particular, the fluid is cleaned in the fluid recycling unit before being fed back into the conveying chamber. It is advantageously possible to prevent dust and/or fluid that has escaped from the material being conveyed to pass back into the conveying chamber with the fed-back fluid.

The above-described characteristics, features and advantages of this invention, and the manner in which these are achieved, will become clearer and more clearly understandable in conjunction with the following description of exemplary embodiments, which will be discussed in more detail in conjunction with the drawings, in which:

DESCRIPTION OF EMBODIMENTS

Parts which correspond to one another are denoted by the same reference designations in the Figures.

Figure 1:
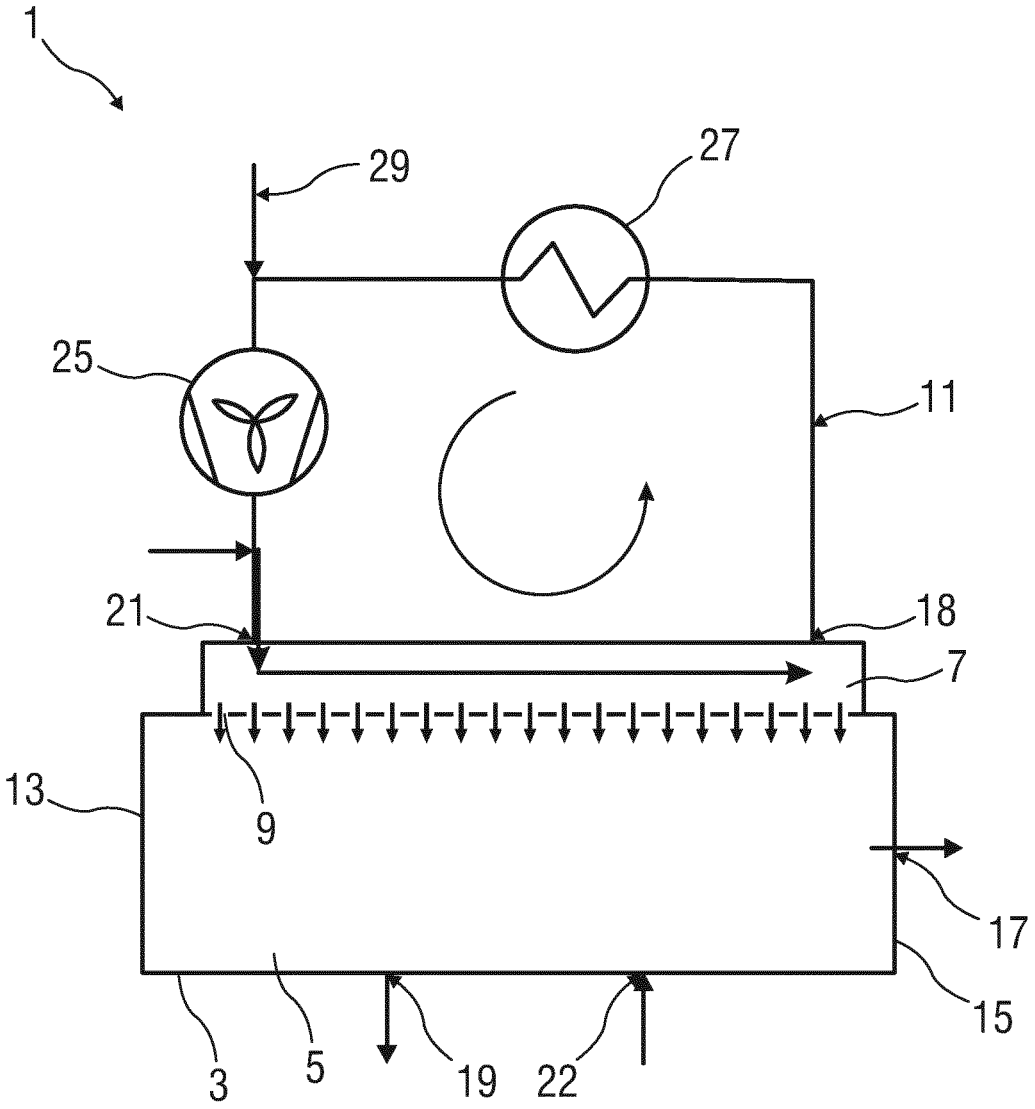
FIG. 1 schematically shows a first exemplary embodiment of a conveying installation with a first exemplary embodiment of a fluid circuit system, FIG. 2 schematically shows a second exemplary embodiment of a conveying installation.

FIG. 1 schematically shows a first exemplary embodiment of a conveying installation 1 for conveying a material being conveyed along a conveying path. The conveying installation 1 comprises an installation housing 3, which has a conveying chamber 5 and a secondary chamber 7. At least the conveying path is arranged in the conveying chamber 7. The secondary chamber 7 is arranged laterally at the conveying chamber 5 and is connected to the conveying chamber 5 by multiple passage openings 9. Furthermore, the conveying installation 1 has a fluid circuit system 11 which comprises the secondary chamber 7 and which is designed for conducting a fluid, for example an inert gas, through the passage openings 9 from the secondary chamber 7 into the conveying chamber 5. Flow directions of the fluid are indicated in FIG. 1 by arrows. Instead of multiple passage openings 9, it is also possible for one continuous slot-like passage opening 9 to be provided.

The material being conveyed is for example a reactive and/or hot and/or abrasive material being conveyed. In particular, harmful and/or environmentally damaging fluid may escape from the material being conveyed, which fluid therefore should not escape in uncontrolled fashion into the environment. Furthermore, dust may form during the transport of the material being conveyed in the conveying chamber 5.

The conveying chamber 5 and the secondary chamber 7 have fluid atmospheres which fluid atmospheres differ physically and/or chemically. In particular, the fluid atmosphere in the secondary chamber 7 has a higher fluid pressure than the fluid atmosphere in the conveying chamber 5. Fluid flows through the passage openings 9 from the secondary chamber 7 substantially into the conveying chamber 5, and do not flow in the opposite direction from the conveying chamber 5 into the secondary chamber 7. The fluid atmosphere in the conveying chamber 5 may, in particular in the case of a hot material being conveyed, have a higher temperature than the fluid atmosphere in the secondary chamber 7, and/or the atmosphere in the conveying chamber may contain gas that has escaped from the material being conveyed and/or may contain dust that forms during the transport of that material being conveyed. The relatively high fluid pressure in the secondary chamber 7 and the resulting fluid flow from the secondary chamber 7 into the conveying chamber 5 advantageously also prevent ingress of the gas and/or dust from the conveying chamber 5 into the secondary chamber 7.

The conveying path runs in the conveying chamber 5 between a first conveying chamber end 13 and a second conveying chamber end 15. In the region of the first conveying chamber end 13, material being conveyed is introduced into the conveying chamber 5. At the second conveying chamber end 15, the material being conveyed is discharged from the conveying chamber 5. The first conveying chamber end 13 is for example configured to be closed or closable, whereas the second conveying chamber end 15 has a first fluid outlet 17 through which the fluid flows out of the conveying chamber 5, for example together with the material being conveyed. The installation housing 3 furthermore has a second fluid outlet 18 through which fluid circulating in the fluid circuit system 11 is discharged from the secondary chamber 7. Furthermore, the installation housing 3 may have further fluid outlets 19 through which fluid can be extracted from the conveying chamber 5, for example if a fluid pressure in the conveying chamber 5 overshoots a pressure threshold value. Such fluid outlets 19 may for example have in each case one safety element, for example a safety valve, for example if a safety study considers this to be necessary.

The installation housing 3 furthermore has a first fluid inlet 21, through which fluid circulating in the fluid circuit system is fed into the secondary chamber 7. Furthermore, the installation housing 3 may have further fluid inlets 22, through which fluid can be fed to the conveying chamber 5, for example in order to influence a fluid flow in the conveying chamber 5. Aside from the fluid outlets 17 to 19 and the fluid inlets 21, 22, the installation housing 3 is of fluid-tight design. In other exemplary embodiments, the first fluid inlet 21 and/or the second fluid outlet 18 may also be arranged at locations other than the locations of the secondary chamber 7 shown in FIG. 1, for example they may be interchanged with one another in relation to FIG. 1.

By means of this substantially fluid-tight design of the installation housing 3, escape of fluid from the installation housing 3 is restricted to the fluid outlets 17 to 19, such that an only relatively small amount of fluid escapes from the installation housing 3. Furthermore, fluid that has been discharged from the second fluid outlet 18 is fed back to the secondary chamber 7 through the fluid circuit system 11 via the first fluid inlet 21. Moreover, fluid emerging from the first fluid outlet 17 and/or from at least one further fluid outlet 19 may possibly be at least partially collected, fed to the fluid circuit system 11 (possibly after cleaning, see FIG. 2 and FIG. 8) and recycled. Altogether, it is thus possible for the amount of fluid to be fed to the installation housing 3 to be kept relatively low. In this way, the consumption of fluid and the costs for the fluid are advantageously reduced.

A further advantage of the substantially fluid-tight design of the installation housing 3 and of the higher fluid pressure in the secondary chamber 7 in relation to the conveying chamber 5 is that harmful and/or environmentally damaging fluid that has escaped from the material being conveyed can likewise emerge from the conveying chamber 5 only at the fluid outlets 17, 19 and can be disposed of there. The same applies to dust that is situated in the conveying chamber 5.

Components of the conveying mechanism for conveying the material being conveyed are arranged in the secondary chamber 7.

The fluid circuit system 11 conducts fluid through the secondary chamber 7, out of the secondary chamber 7 through the second fluid outlet 18, and, for example by means of pipelines, via a turbomachine 25 and optionally via a heat exchanger 27 and back into the secondary chamber 7 through the first fluid inlet 21. Furthermore, the fluid circuit system 11 has a fluid feed 29, through which fluid can be fed to the fluid circuit system 11, particularly to replace fluid that is discharged from the secondary chamber 7 into the conveying chamber 5 through the passage openings 9.

The turbomachine 5 is a blower or a pump, depending on whether the fluid is a gas or a liquid.

The optional heat exchanger 27 serves for cooling the fluid. It is advantageous in particular in cases in which a hot material being conveyed is transported in the conveying chamber 5 and also components, all of which are to be cooled, of a conveying mechanism for conveying the material being conveyed are arranged in the secondary chamber 7. In these cases, the fluid conducted into the secondary chamber 7 and cooled by the heat exchanger 27 can advantageously also be used for cooling the components of the conveying mechanism arranged in the secondary chamber 7. Alternatively or in addition, the conveying installation may have a separate cooling device (not illustrated) for cooling the secondary chamber 7. For example, the cooling device may have a cooling pipe which is fillable with a coolant or may have multiple cooling pipes, wherein at least one cooling pipe may be situated within the secondary chamber 7.

Figure 2:
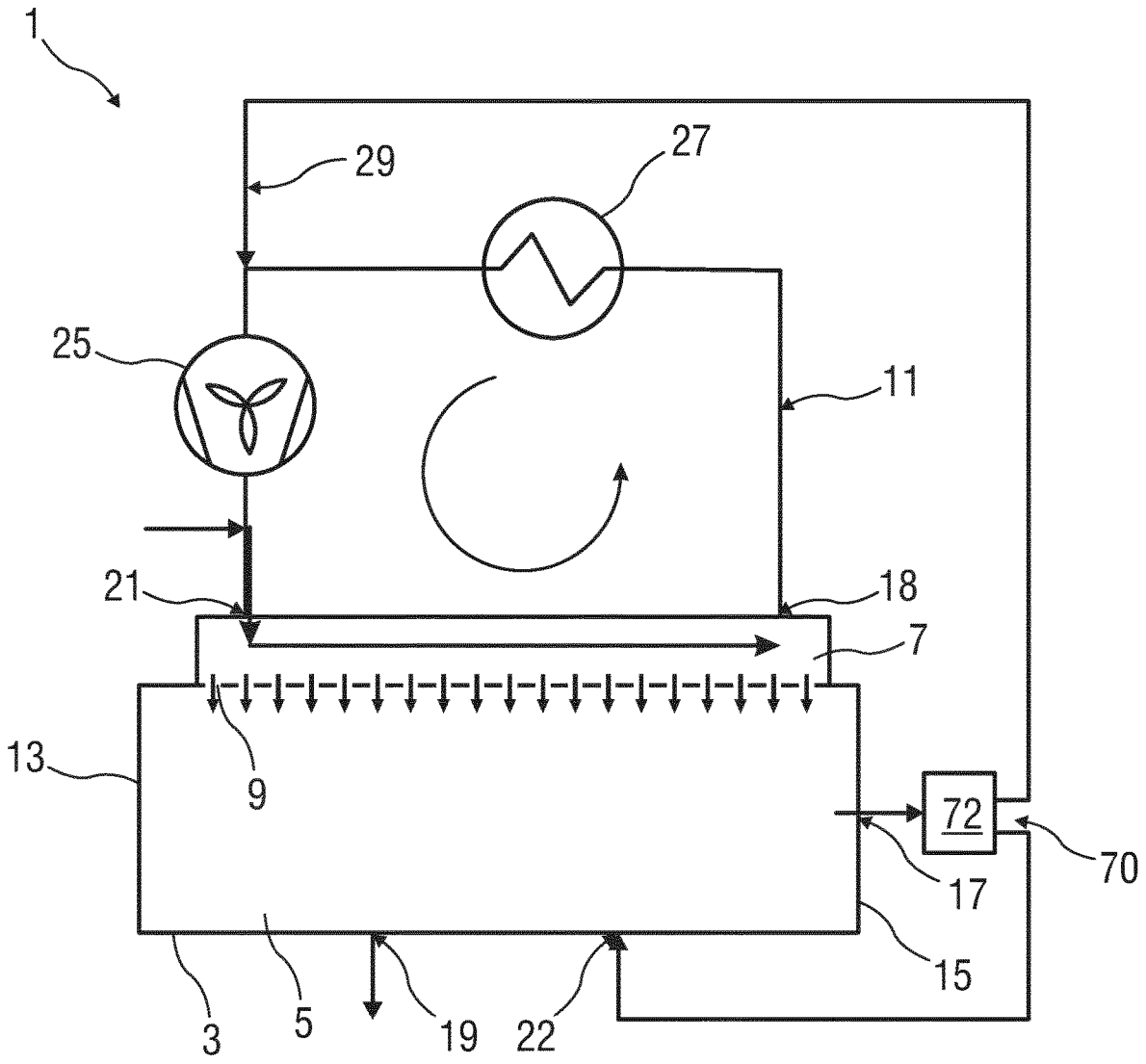

FIG. 2 schematically shows a second exemplary embodiment of a conveying installation 1. The conveying installation 1 differs from the exemplary embodiment illustrated in FIG. 1 substantially by a fluid recycling unit 70 for receiving fluid that emerges from the conveying chamber 5 through the fluid outlet 17. The fluid recycling unit 70 has a fluid cleaning unit 72 for cleaning the fluid that is received from the conveying chamber 5. A part of the cleaned fluid is fed back directly into the conveying chamber 5 via a fluid inlet 22. The other part of the cleaned fluid is fed back into the conveying chamber 5 indirectly by being fed to the fluid circuit system 11 via the fluid feed 29. In the ideal case, all of the fluid that emerges from the conveying chamber 5 is fed back into the conveying chamber 5, such that no further infeed of fluid into the conveying installation 1 is necessary.

Modifications of the exemplary embodiment shown in FIG. 2 may provide for the fluid recycling unit 70 to alternatively or additionally receive fluid emerging from the conveying chamber 5 from another fluid outlet 19. Furthermore, provision may be made for fluid to be alternatively or additionally fed back directly into the conveying chamber 5 through the fluid outlet 17. Further modifications of the embodiment shown in FIG. 2 may provide for fluid to be fed back into the conveying chamber 5 either only indirectly via the fluid circuit system 11 or only directly. Furthermore, fluid may be fed to the fluid circuit system 11 at some other location instead of via the fluid feed 29, for example upstream of the heat exchanger 27, in order to cool the fluid. Furthermore, the fluid cleaning unit 72 may be omitted if cleaning of the fluid is not necessary.

Figure 3:
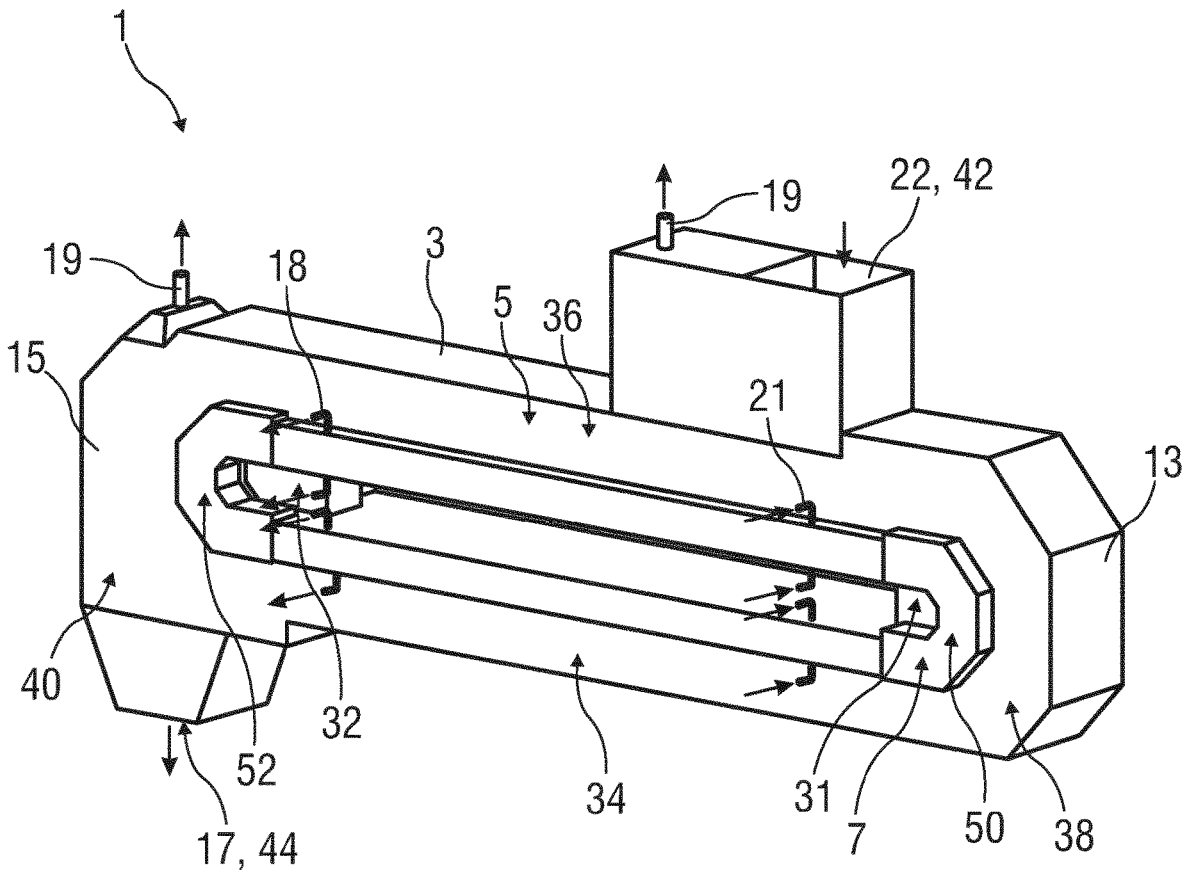
FIG. 3 shows a perspective illustration of a third exemplary embodiment of a conveying installation, FIG. 4 schematically shows a sectional illustration of the conveying installation illustrated in FIG. 3.
Figure 4:
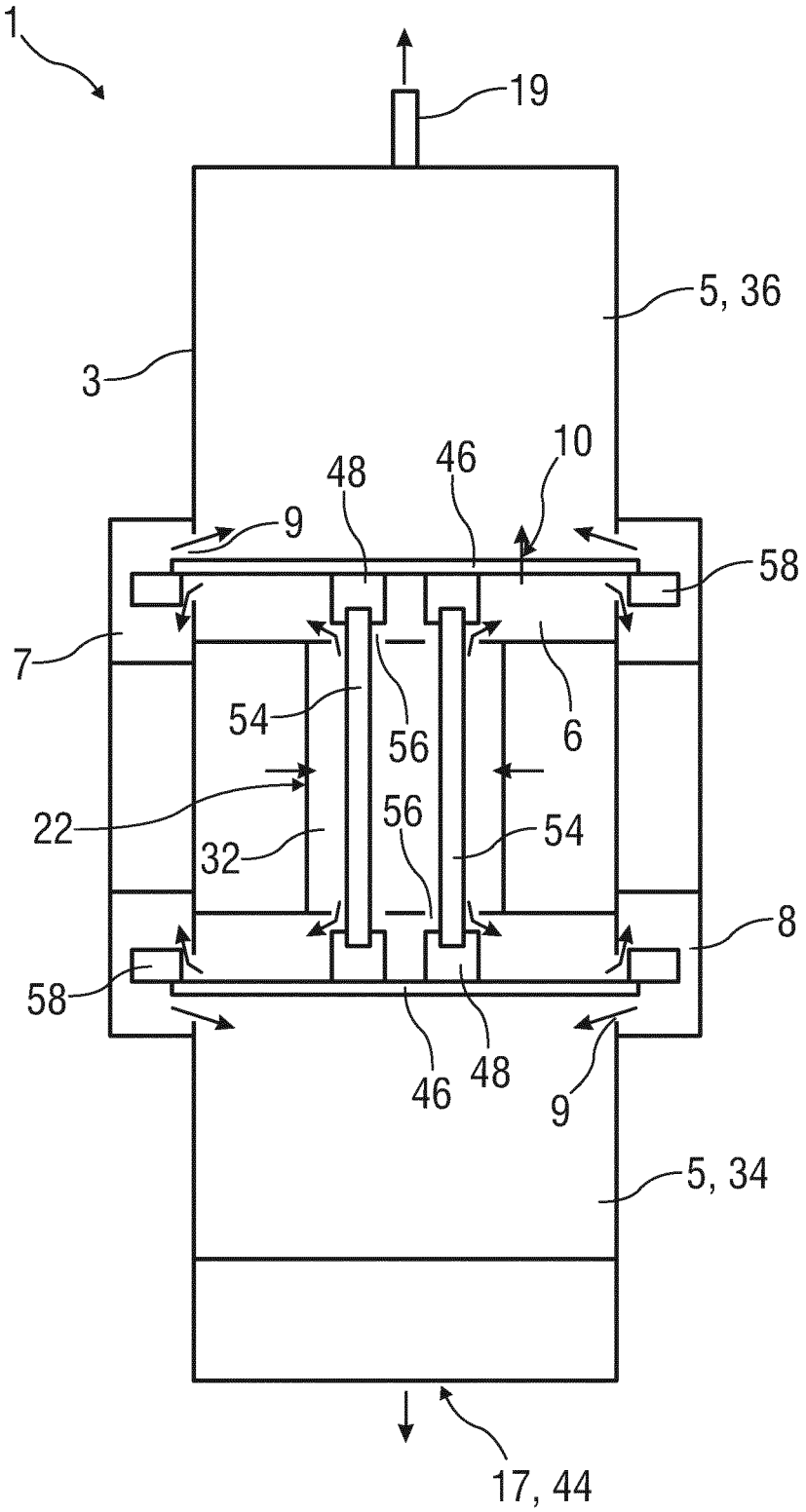

FIGS. 3 and 4 show a third exemplary embodiment of a conveying installation 1 for conveying a material being conveyed along a conveying path. FIG. 3 shows a perspective view of the conveying installation 1. FIG. 4 shows a sectional illustration of the conveying installation 1.

The conveying installation 1 comprises an installation housing 3, which has a conveying chamber 5, three secondary chambers 6 to 8, and two additional chambers 31, 32.

The conveying chamber 5 is of a generally ring-shaped form including two horizontally running horizontal portions 34, 36 and two vertically running diverting portions 38, 40. The lower horizontal portion 34 runs below and is spaced apart from an upper horizontal portion 36. The diverting portions 38, 40 form oppositely situated conveying chamber ends 13, 15 of the conveying chamber 5 and each diverting portion connects the two horizontal portions 34, 36 to one another. The conveying path runs in the upper horizontal portion 36 of the conveying chamber 5 between a first conveying chamber end 13 formed by a first diverting portion 38 and a second conveying chamber end 15 formed by a second diverting portion 40. In the vicinity of the first conveying chamber end 13, the installation housing 3 has a charging inlet 42 which is arranged above the upper horizontal portion 36, through which material being conveyed is introduced into the conveying chamber 5. In the region of the second conveying chamber and 15, the installation housing 3 has a discharge opening 44 which is arranged below the second diverting portion 40 and through which material being conveyed is discharged out of the conveying chamber 5.

The secondary chambers 6 to 8 are each of ring-shaped form. The conveying chamber 5 runs around a first secondary chamber 6, wherein a bottom side of the upper horizontal portion 36, a top side of the lower horizontal portion 34 and the two diverting portions 38, 40 of the conveying chamber 5 join the first secondary chamber 6. A second secondary chamber 7 and a third secondary chamber 8 are arranged at different sides of the first secondary chamber 6 and each adjoins an outer side of the first secondary chamber 6 along the entire ring-shaped course thereof.

The conveying chamber 5 and the first secondary chamber 6 are separated from one another by carrier elements 46, which transport the material being conveyed. The material being conveyed is for example transported directly by the carrier elements 46 or in containers arranged on the carrier elements 46. The carrier elements 46 are configured for example as carrier plates. Traction mechanisms 48 are arranged in the first secondary chamber 6. Each traction mechanism runs in encircling fashion within the first secondary chamber 6 along its ring-shaped course and each is connected to the carrier elements 46. The traction mechanisms 48 are for example configured as drive chains. The carrier elements 46 are movable with the traction mechanisms 48 along a closed path, which comprises the conveying path, in the installation housing 3. Each traction mechanism 48 runs, below the upper horizontal portion 36 and above the lower horizontal portion 34 of the conveying chamber 5, rectilinearly between two diverting regions 50, 52 which are each situated in the region of one of the conveying chamber ends 13, 15 and in which the traction mechanism 48 is diverted.

The traction mechanisms 48 are each driven by drive wheels 54, each arranged in a diverting region 50, 52 of the traction mechanisms 48. The traction mechanisms 48 and their drive wheels 54 form a traction mechanism drive, which move the carrier elements 46. A respective one of the two additional chambers 31, 32 is arranged at each diverting region 50, 52. The drive wheels 54 of the diverting region 50, 52 are arranged in the additional chambers. Each additional chamber 31, 32 adjoins the first secondary chamber 6. For each drive wheel 54 arranged therein, each additional chamber has connecting openings 56 to the first secondary chamber 6, through which connecting openings the drive wheel 54 projects into the first secondary chamber 6.

The second secondary chamber 7 and the third secondary chamber 8 are each connected by a passage opening 9, which opening for example, runs in a ring-shaped encircling fashion and is of slot-like form, to the conveying chamber 5 and to the first secondary chamber 6. The carrier elements 46 project through the passage openings 9 into the second secondary chamber 7 and into the third secondary chamber 8. Guide wheels 58 are arranged in the second secondary chamber 7 and in the third secondary chamber 8 which guide the carrier elements 46. At least one secondary chamber 6 to 8 may furthermore additionally be connected by at least one further passage opening 10 to the conveying chamber 5. For example, further passage openings 10 between the first secondary chamber 6 and the conveying chamber 5 may be realized by gaps between the carrier elements 46.

Analogously to the first exemplary embodiment illustrated in FIG. 1, the installation housing 3 has fluid outlets 17 to 19 and fluid inlets 21, 22. A first fluid outlet 17 coincides for example with the discharge opening 44. Furthermore, the second secondary chamber 7 and/or the third secondary chamber 8 may have at least one second fluid outlet 18, and/or the conveying chamber 5 may have at least one further fluid outlet 19. Furthermore, the second secondary chamber 7 and/or the third secondary chamber 8 may have at least one first fluid inlet 21, and/or the conveying chamber 5 and/or the first secondary chamber 6 and/or at least one additional chamber 31, 32 may have at least one further fluid inlet 22, wherein, for example, the charging inlet 42 may be a fluid inlet 22.

As in the first exemplary embodiment illustrated in FIG. 1, the installation housing 3 is of fluid-tight design, aside from the fluid outlets 17 to 19 and the fluid inlets 21, 22. This has the advantages described above with regard to a reduced fluid amount requirement and a controlled discharge and disposal of gas and dust from the conveying chamber 5.

Further, the conveying chamber 5 and the secondary chambers 6 to 8 have, as in the first embodiment in FIG. 1, fluid atmospheres which differ physically and/or chemically. In particular, the fluid atmospheres in each secondary chamber 6 to 8, which are connected to the conveying chamber 5 by means of at least one passage opening 9, 10, have a higher fluid pressure than the fluid atmosphere in the conveying chamber 5. This achieves that fluid, dust and gas that has escaped from the material for being conveyed do not flow directly out of the conveying chamber 5 into the secondary chambers 6 to 8, but instead flow in the conveying chamber 5 in a controlled manner to the fluid outlets 17 to 19. Furthermore, the components of the conveying mechanism that are arranged in the secondary chambers 6 to 8, in particular the traction mechanisms 48 and drive wheels 54, can be cooled by fluid that is conducted into the secondary chambers 6 to 8. The opening widths of the passage openings 9, 10 may vary along the courses of the passage openings 9, 10. For example, the slot-like passage openings 9 may be wider in the diverting regions 50, 52 of the traction mechanisms 48 than between the diverting regions 50, 52. Regions of the secondary chambers 6 to 8 with relatively narrow passage openings 9, 10 are particularly advantageously suitable for the cooling of components of the conveying mechanism arranged in the secondary chambers by fluid in the secondary chambers 6 to 8. Such components include the traction mechanisms 48 and drive wheels 54, because particularly high fluid flows of the fluid arise in those regions in the secondary chamber. Furthermore, regions of the secondary chambers 6 to 8 with relatively narrow passage openings 9, 10 are particularly advantageously suitable for the introduction of fluid into the secondary chambers 6 to 8, because less fluid flows from the secondary chambers 6 to 8 into the conveying chamber 5 in these regions than in regions with relatively wide passage openings 9, 10, such that the introduced fluid can be distributed over greater regions of the secondary chambers 6 to 8.

Analogously to the first exemplary embodiment illustrated in FIG. 1, the exemplary embodiment shown in FIGS. 3 and 4 may also have a fluid circuit system 11 to control and optimize the fluid flow. FIGS. 4 to 7 show block diagrams of different embodiments of such fluid circuit systems 11.

The exemplary embodiment of a conveying installation 1 illustrated in FIGS. 3 and 4 may be modified in a variety of ways. For example, traction mechanisms 48 may be arranged below, above and/or to the side of the conveying chamber 5, and/or a different number of traction mechanisms 48 may be provided, for example only one traction mechanism 48. Further, separate additional chambers 31, 32 for the drive wheels 54 may be omitted. Further, the conveying path may also run at an angle with respect to the horizontal, instead of running horizontally, or may have a course which deviates from a straight course, for example an S-shaped or a Z-shaped course, wherein the installation housing 3 is designed correspondingly to the course of the conveying path. Furthermore, the fluid outlet 17 may also be operated as a (further) fluid inlet.

Figure 5:
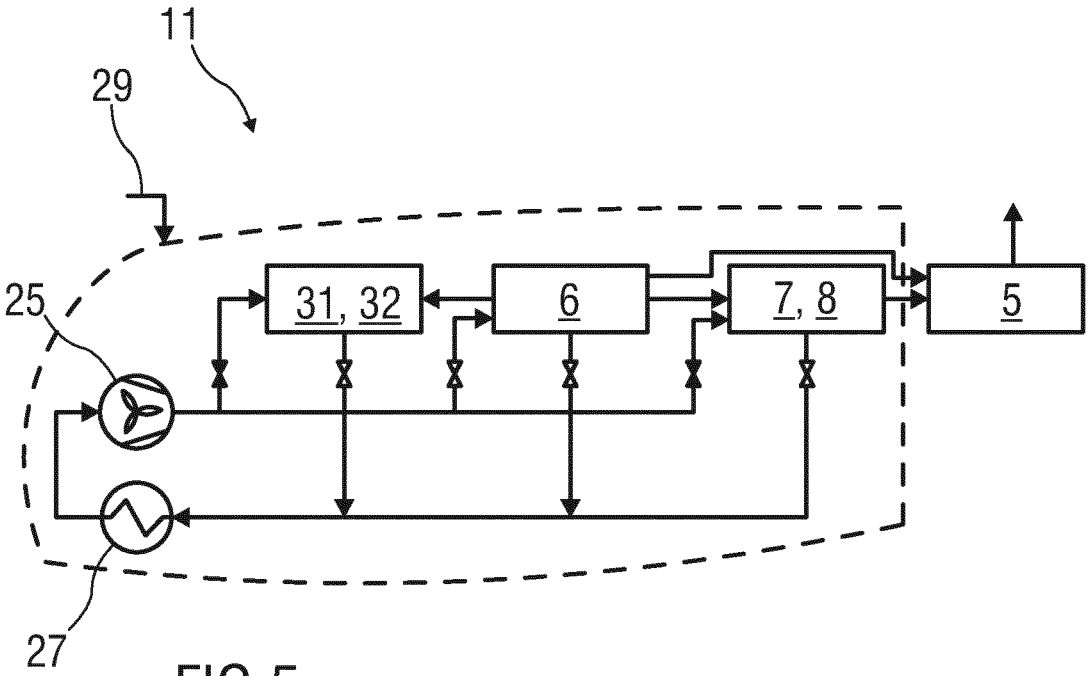
FIG. 5 shows a block diagram of a second exemplary embodiment of a fluid circuit system of a conveying installation.

FIG. 5 shows a fluid circuit system 11 into which the secondary chambers 6 to 8 and the additional chambers 31, 32 are integrated. The fluid circuit system 11 conducts fluid through each secondary chamber 6 to 8 and each additional chamber 31, 32, discharges fluid from the secondary chambers 6 to 8 and the additional chambers 31, 32, and conducts the fluid via a turbomachine 25 and optionally via a heat exchanger 27 back to the secondary chambers 6 to 8 and/or to the additional chambers 31, 32. Furthermore, fluid is conducted from the secondary chambers 6 to 8 through the passage openings 9, 10 into the conveying chamber 5. The fluid circuit system 11 has a fluid feed 29, through which fluid can be fed to the fluid circuit system 11, in particular to replace fluid that is discharged from the secondary chambers 6 to 8 through the passage openings 9, 10 into the conveying chamber 5. The first secondary chamber 6 has a higher fluid pressure than the other secondary chambers 7, 8, than the additional chambers 31, 32 and than the conveying chamber 5, such that fluid flows from the first secondary chamber 6 into the other secondary chambers 7, 8, the additional chambers 31, 32 and the conveying chamber 5. Furthermore, the second secondary chamber 7 and the third secondary chamber 8 have a higher fluid pressure than the conveying chamber 5, such that fluid flows from the second secondary chamber 7 and the third secondary chamber 8 into the conveying chamber 5.

Figure 6:
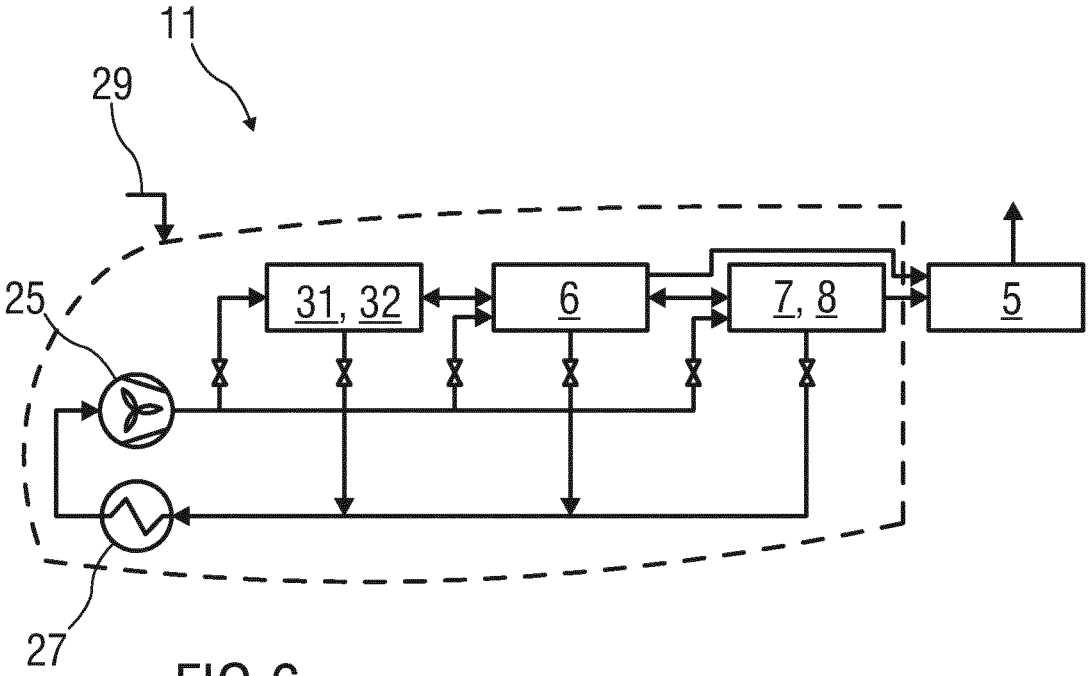
FIG. 6 shows a block diagram of a third exemplary embodiment of a fluid circuit system of a conveying installation.

FIG. 6 shows a fluid circuit system 11 which differs from the fluid circuit system 11 shown in FIG. 5 only in that the secondary chambers 6 to 8 and the additional chambers 31, 32 have an identical fluid pressure, such that fluid is exchanged between the secondary chambers 6 to 8 and the additional chambers 31, 32. The fluid pressure in the secondary chambers 6 to 8 is again higher than in the conveying chamber 5, such that fluid flows from each secondary chamber 6 to 8 into the conveying chamber 5.

Figure 7:
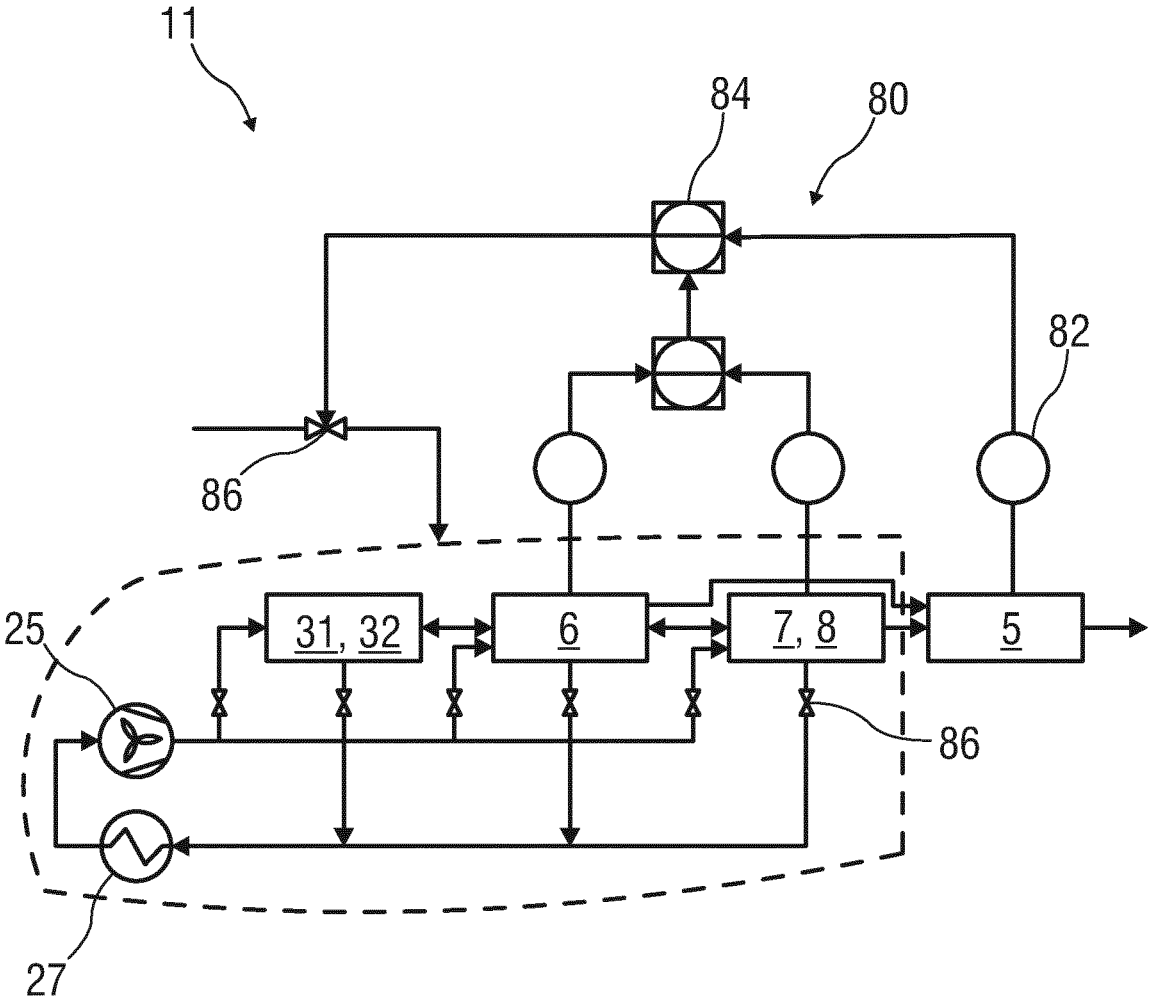
FIG. 7 shows a block diagram of a fourth exemplary embodiment of a fluid circuit system of a conveying installation.

FIG. 7 shows a fluid circuit system 11 which differs from the fluid circuit system 11 shown in FIG. 6 only by a closed-loop control system 80 for the closed-loop control of fluid flows between the secondary chambers 6 to 8 and the conveying chamber 5. The closed-loop control system 80 comprises pressure measuring devices 82 for detecting pressures in the secondary chambers 6 to 8 and the conveying chamber 5 and control units 84 for monitoring pressure differences between the pressures and for the closed-loop control of the fluid flows between the secondary chambers 6 to 8 and the conveying chamber 5 in a manner dependent on the pressure differences. The closed-loop control of the fluid flows is performed by an activation of control valves 86 of the fluid circuit system 11.

Figure 8:
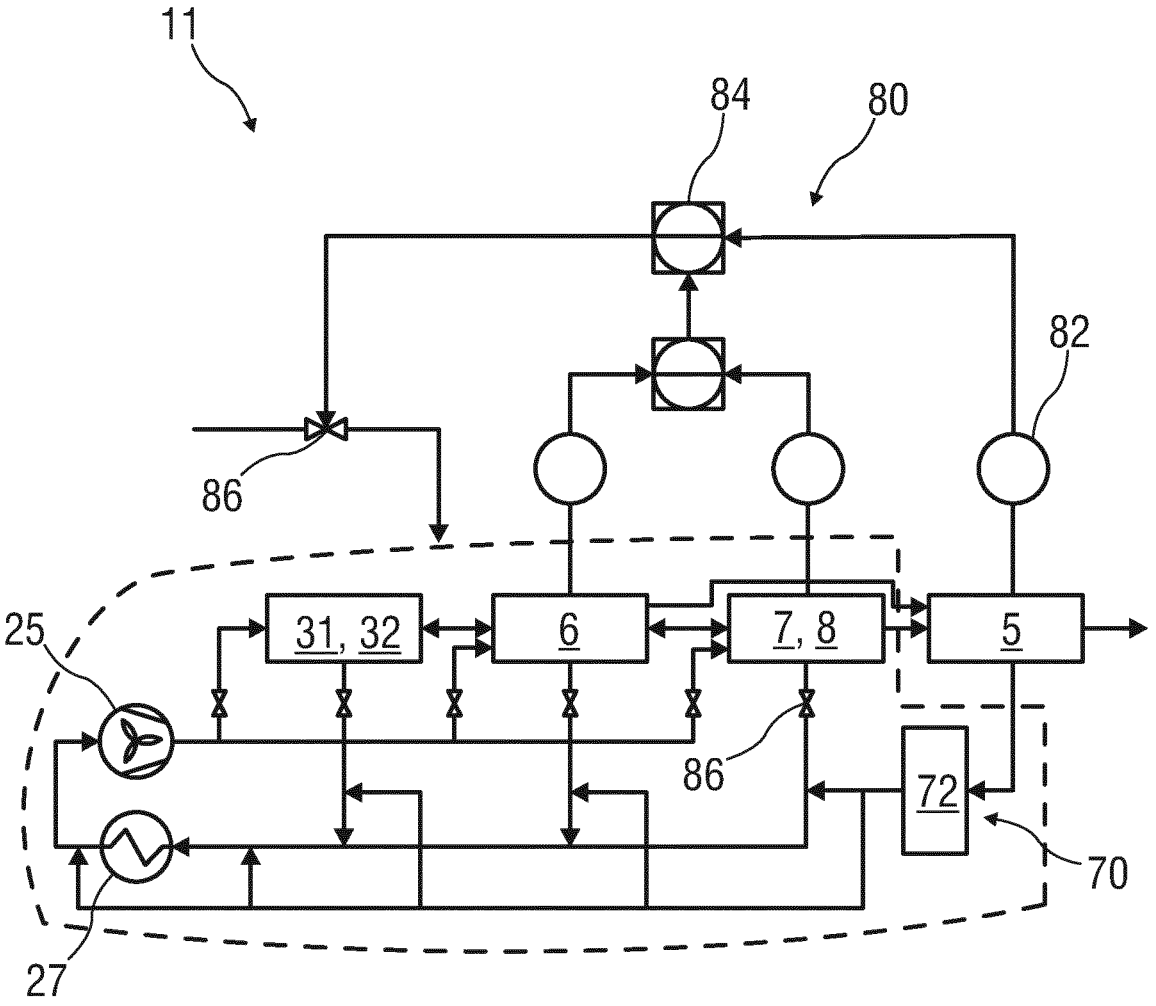
FIG. 8 shows a block diagram of a fifth exemplary embodiment of a fluid circuit system of a conveying installation.

FIG. 8 shows a fluid circuit system 11, which differs from the fluid circuit system 11 shown in FIG. 7 only in that fluid emerging from the conveying chamber 5 through fluid outlet 17, 19 is partially collected, and fed back to the fluid circuit system 11, by a fluid recycling unit 70. The fluid recycling unit 70 may optionally have a fluid cleaning unit 72, for cleaning fluid that has emerged from the conveying chamber 5, for example cleaning gas that has escaped from the material being conveyed and/or of dust, before being fed to the fluid circuit system 11.

Figure 9:
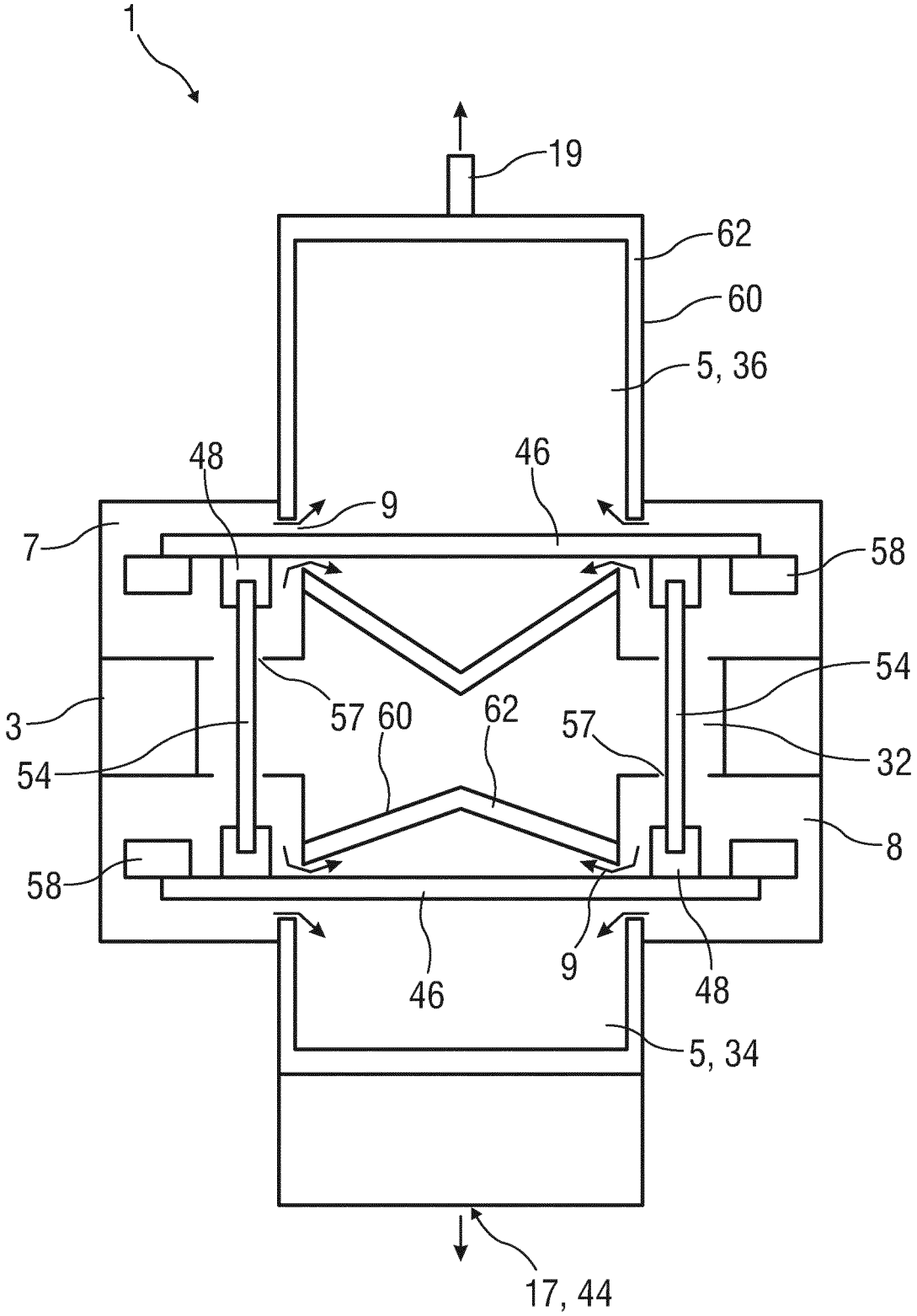
FIG. 9 shows a sectional illustration of a fourth exemplary embodiment of a conveying installation.

FIG. 9 shows a sectional illustration of a fourth exemplary embodiment of a conveying installation 1. This exemplary embodiment differs from the exemplary embodiment shown in FIGS. 3 and 4 substantially only in that the first secondary chamber 6 has been omitted and the conveying chamber 5 extends into a region which is occupied by the first secondary chamber 6 in the exemplary embodiment shown in FIGS. 3 and 4. The traction mechanisms 48, which in the exemplary embodiment shown in FIGS. 3 and 4 are arranged in the first secondary chamber 6, are arranged in the secondary chambers 7, 8 in the exemplary embodiment shown in FIG. 9, wherein a traction mechanism 48 is arranged in each of the secondary chambers 7, 8.

Analogously to the exemplary embodiment shown in FIGS. 3 and 4, the secondary chambers 7, 8 are each connected to the conveying chamber 5 by a slot-like passage opening 9 which runs in a ring-shaped encircling fashion. The carrier elements 46 project through the passage openings 9 and into the secondary chambers 7, 8. In each secondary chamber 7, 8, there are guide wheels 58 by which the carrier elements 46 are guided.

Analogously to the exemplary embodiment shown in FIGS. 3 and 4, each traction mechanism is driven by two drive wheels 54, which are arranged in each case in a diverting region 50, 52 of the traction mechanism 48 and are in contact with the traction mechanism 48. At each diverting region 50, 52, there is again arranged an additional chamber 31, 32 in which the drive wheels 54 of the diverting region 50, 52 are arranged. Each additional chamber 31, 32 adjoins both secondary chambers 7, 8 and, for each of the drive wheels 54 arranged therein, each additional chamber has connecting openings 57 through which the drive wheel 54 projects into the respective secondary chamber 7, 8, in which the traction mechanism 48 connected to the drive wheel 54 is arranged.

By contrast to the exemplary embodiment shown in FIGS. 3 and 4, the carrier elements 46 do not delimit the conveying chamber 5, but rather are spaced apart from a conveying chamber wall 60 of the conveying chamber 5. The conveying chamber wall 60 may have a thermal insulation layer 62.

Relocation of the traction mechanisms 48 into the secondary chambers 7, 8, simplifies the construction of the installation housing 3 in relation to the exemplary embodiment shown in FIGS. 3 and 4, owing to the omission of the first secondary chamber 6, which, in that exemplary embodiment, forms a separate traction mechanism chamber for the traction mechanisms 48. Furthermore, the cooling of the traction mechanisms 48, which drive transport of hot material being conveyed, is simplified. First, cooling of the first secondary chamber 6 is omitted. Secondly, driving the transport of hot material for conveying, the traction mechanisms 48 are less intensely heated, and therefore also require less intense cooling, because the traction mechanisms 48 are no longer arranged at a central region of the carrier elements 46, which region is particularly intensely heated by the material being conveyed. Instead, the traction mechanisms are arranged at the relatively cool edge regions of the carrier elements 46, with a considerably greater spacing from the material for conveying.

The spacing of the carrier elements 46 from the conveying chamber wall 60 causes a substantially homogeneous fluid atmosphere to form above and below the carrier elements 46. It is advantageous that temperature differences and turbulent flows within the conveying chamber 5 are reduced. The spacing of the carrier elements 46 from the conveying chamber wall 60 and thermal insulation of the conveying chamber wall 60 by thermal insulation layer 62 reduces heat losses from the conveying chamber 5. In that case, during transport of hot material being conveyed, the temperature of the material can be more effectively kept at an approximately constant level along the conveying path.

The exemplary embodiment of a conveying installation 1 shown in FIG. 9 may be modified such that the additional chambers 31, 32 may be omitted. For example, the secondary chambers 7, 8 may be enlarged, such that each drive wheel 54 is arranged in one secondary chamber 7, 8.

Furthermore, the installation housing 3 may be designed for discharging material being conveyed that falls from carrier elements 46 during their conveyance along the conveying path, in a manner such that the conveying chamber 5 does not gradually become blocked by material being conveyed that falls from carrier elements 46. For this purpose, as in FIG. 9, the base of the upper region of the conveying chamber 5 has a trough-like form and is inclined relative to the horizontal, such that material being conveyed that falls from carrier elements 46 can slide to a disposal opening in the conveying chamber wall 60, for example an opening in the base of the upper region of the conveying chamber 5, and can from there be discharged from the conveying chamber 5 through the disposal opening. Alternatively, the base of the upper region of the conveying chamber 5 may also have one continuous disposal opening. There are fluid-tight chutes arranged under that opening, fluid-tight chutes via which material being conveyed that falls from the carrier elements 46 is disposed of. The installation housings 3 of conveying installations 1 that are shown in FIGS. 1 to 4 may also be similarly designed for discharging material being conveyed that falls from carrier elements 46 during the conveyance along the conveying path.

Although the invention has been illustrated and described in more detail on the basis of preferred exemplary embodiments, the invention is not restricted by the disclosed examples, and other variations may be derived from these by a person skilled in the art without departing from the scope of protection of the invention.

LIST OF REFERENCE DESIGNATIONS

1 Conveying installation
3 Installation housing
5 Conveying chamber
6 to 8 Secondary chamber
9, 10 Passage opening
11 Fluid circuit system
13, 15 Conveying chamber end
17 to 19 Fluid outlet
21, 22 Fluid inlet
25 Turbomachine
27 Heat exchanger
29 Fluid feed
31, 32 Additional chamber
34, 36 Horizontal portion
38, 40 Vertical portion
42 Charging inlet
44 Discharge opening
46 Carrier element
48 Traction mechanism
50, 52 Diverting region
54 Drive wheel
56, 57 Connecting opening
58 Guide wheel
60 Conveying chamber wall
62 Heat insulation layer
70 Fluid recycling unit
72 Fluid cleaning unit
80 Closed-loop control system
82 Pressure measuring device
84 Control unit
86 Control valve

The invention claimed is:

1. A conveying installation for conveying a material for being conveyed along a conveying path, the conveying installation comprising:

an installation housing including a conveying chamber in which the conveying path is arranged;

at least one secondary chamber connected by at least one passage opening to the conveying chamber;

the at least one secondary chamber is configured to have a first fluid atmosphere therein and the conveying chamber is configured and operable to have a second fluid atmosphere therein;

the first and second fluid atmospheres differ physically and/or chemically from each other;

the at least one passage opening, physical and/or chemical characteristics of the second fluid atmosphere in the conveying chamber, and physical and/or chemical characteristics of the first fluid atmosphere in the at least one secondary chamber define a fluid flow in the installation housing;

a conveying mechanism having at least one component configured for conveying the material being conveyed and the at least one component is arranged in the at least one secondary chamber; and the conveying mechanism having a traction mechanism drive comprising at least one traction mechanism, which is arranged in the at least one secondary chamber, and having carrier elements which are movable for conveying the material being conveyed.

2. The conveying installation as claimed in claim 1, wherein the installation housing further including at least one fluid inlet and at least one fluid outlet, and the installation housing is of fluid-tight construction, except for the at least one fluid inlet and the at least one fluid outlet.

3. The conveying installation as claimed in claim 1, wherein the carrier elements separate the conveying chamber from the at least one secondary chamber in which the at least one traction mechanism is arranged.

4. The conveying installation as claimed in claim 1, wherein the carrier elements are arranged in the conveying chamber and the carrier elements project through a passage opening into the at least one secondary chamber.

5. The conveying installation as claimed in claim 4, wherein the carrier elements project into the at least one secondary chamber, the at least one secondary chamber is arranged laterally at the conveying chamber and at least one traction mechanism is arranged in the at least one secondary chamber.

6. The conveying installation as claimed in claim 1, further comprising a fluid circuit system which comprises at least one of the secondary chambers and which is configured for conducting a fluid through at least one of the passage openings from the secondary chamber into the conveying chamber.

7. The conveying installation as claimed in claim 6, further comprising the fluid circuit system has at least one heat exchanger for cooling a fluid fed to one of the secondary chambers.

8. The conveying installation as claimed in claim 1, further comprising a fluid recycling unit configured for receiving fluid that exits from the conveying chamber and for feeding the fluid that exited back into the conveying chamber.

9. The conveying installation as claimed in claim 8, wherein the fluid recycling unit includes a fluid cleaning unit for cleaning the fluid received from the conveying chamber by the fluid cleaning unit.

10. The conveying installation as claimed in claim 1, further comprising:

a closed-loop control system for closed-loop control of a fluid flow from the at least one secondary chamber into the conveying chamber dependent on a pressure difference between a pressure in the at least one secondary chamber and a pressure in the conveying chamber.

11. A method for operating a conveying installation the installation being according to claim 1, the method comprising setting a higher fluid pressure in the at least one secondary chamber than the fluid pressure in the conveying chamber.

12. The method as claimed in claim 11, further comprising receiving fluid from the conveying chamber by a fluid recycling unit and feeding the fluid back from the recycling unit into the conveying chamber directly and/or via the at least one secondary chamber.

13. The method as claimed in claim 12, further comprising cleaning the fluid in the fluid recycling unit before being feeding the fluid back into the conveying chamber.

* * * * *